US006415616B1

(12) United States Patent
Kim

(10) Patent No.: US 6,415,616 B1
(45) Date of Patent: Jul. 9, 2002

(54) METHOD FOR CONTROLLING DEFROST HEATER OF REFRIGERATOR

(75) Inventor: Jae Ho Kim, Changwon (KR)

(73) Assignee: LG Electronics, Inc., Seoul (KR)

( * ) Notice: Subject to any disclaimer, the term of this patent is extended or adjusted under 35 U.S.C. 154(b) by 0 days.

(21) Appl. No.: 09/654,560

(22) Filed: Sep. 1, 2000

(30) Foreign Application Priority Data

Sep. 3, 1999 (KR) ..... 99/37388

(51) Int. Cl.[7] ..... F25B 47/02
(52) U.S. Cl. ..... 62/155; 62/156; 62/234
(58) Field of Search ..... 62/151, 154, 155, 62/156, 234, 275, 276, 80

(56) References Cited

U.S. PATENT DOCUMENTS 4,887,436 A * 12/1989 Enomoto et al. ..... 62/156 X
4,938,027 A * 7/1990 Midlang ..... 62/234 X
6,058,724 A * 5/2000 Park ..... 62/155 X
6,131,400 A * 10/2000 Seok et al. ..... 62/154

FOREIGN PATENT DOCUMENTS

WO WO 96/16364 5/1996

* cited by examiner

*Primary Examiner*—Harry B. Tanner

(57) ABSTRACT

The present invention relates to a method for controlling a defrost heater of a refrigerator. The method for controlling a defrost heater of a refrigerator, comprising the steps of; accumulating the run time of a compressor and checking whether accumulated time has reached a predetermined time for defrosting; performing a defrost operation, if the predetermined time for defrosting is a first defrosting point of time; checking the current state of the defrost heater if the predetermined time for defrosting is not a first defrosting point of time; turning on the defrost heater to perform the on/off control of the defrost heater, if the defrost heater is turned on/off and thereafter the on/off time reaches a predetermined time; and turning off the defrost heater to finish the defrost operation, if the temperature of cooler has reached a defrost-off temperature during the on/off control of the defrost heater.

5 Claims, 2 Drawing Sheets

METHOD FOR CONTROLLING DEFROST HEATER OF REFRIGERATOR

BACKGROUND OF THE INVENTION

1. Field of the Invention

The present invention relates to a method for controlling a defrost heater of a refrigerator by which defrosting is performed under the on/off control of the defrost heater without continuously heating the defrost heater during a defrost operation, and more particularly, to a method for controlling a defrost heater of a refrigerator by which a temperature rise in a freezing chamber during defrosting is minimized and ice formation in the freezing chamber is minimized for thereby reducing power consumption.

2. Description of the Background Art

Usually, when a refrigerator is operated, articles of food in the refrigerator is frozen(refrigerated). However, in the case where the refrigerator is operated for many hours, its cooling function may not be properly performed because frost and the like are formed in the refrigerator. At this time, a defrost operation is performed by the refrigerator according to a predetermined accumulated operating time of the refrigerator, for thereby normally operating the refrigerator. Here, the above-mentioned defrost operation of the refrigerator will be described.

FIG. 2 is a flow chart of a method for controlling a defrost heater of a refrigerator according to the conventional art. As illustrated therein, the above method includes: a first step of accumulating the run time of a compressor during the operation of the refrigerator; a second step of turning a defrost heater on when the accumulated run time of the compressor reaches a predetermined time; a third step of sensing the temperature of the defrost heater and checking if it reaches a predetermined defrost-off temperature when the defrost heater is on in the second step; and a fourth step of turning the defrost heater off if the sensed temperature of the defrost heater is the defrost-off temperature, or continuously performing the defrost operation if it does not reach the defrost-off temperature.

As illustrated in FIG. 1, a circuit for driving a defrost heater of a refrigerator according to the conventional art, in order to perform the method including the above-described steps, includes: a microcomputer 10 for accumulating the run time of a compressor during the driving of the refrigerator and outputting a control signal for controlling the operation of each unit required to remove frost on a cooler according to the above accumulated time; a defrosting sensor attached around the cooler for sensing the temperature of the cooler; a defrost heater 50 attached to the cooler and turned on to remove frost on the cooler if needed; an inverter 30 for inverting and outputting the output signal of the microcomputer 10 for controlling the defrost heater 50; and a relay 40 for controlling the on/off operation of the defrost heater 50 according to the output of the inverter 30.

The thusly described method for defrosting a refrigerator according to the conventional art will now be described in more detail.

When the refrigerator is driven by applying power, the microcomputer 10 counts the run time of the compressor of the refrigerator using an internal timer, and accumulates the counted time.

When the thusly accumulated run time of the compressor of the refrigerator reaches seven hours, the microcomputer 10 turns the defrost heater on by outputting a control signal of a high state to its output port 01 in order to remove frost adhered to the cooler.

The defrost heater used in the above is a sheathed heater, glass tube heater, or the like.

The control signal of the high state outputted from the output port 01 of the microcomputer 10 is inverted by the inverter 30 and becomes a control signal of a low state.

Accordingly, current flows in a relay coil of the relay 40, and thus a relay switch connected with an a-b terminal is switched over to an a-c terminal for thereby providing power to the defrost heater 50.

Consequently, the defrost heater 50 is turned on to be continuously heated.

When the defrost heater 50 is continuously heated in this way, the defrosting sensor 20 attached around the cooler senses the temperature of the cooler, and transmits the signal of the senses temperature to an analog/digital input terminal AD1 of the microcomputer 10.

Then, the microcomputer 10 recognizes the temperature of the cooler by converting the signal of the sensed temperature inputted into the analog/digital input terminal AD1 and reading the same.

As a result of the recognition, when the temperature of the cooler goes up enough to reach a predetermined defrost-off temperature at a point of time that defrosting is almost finished, the microcomputer 10 outputs a control signal of a low state to its output port 01.

The control signal of the low state from the output port 01 of the microcomputer 10 is converted to a high state by the inverter.

Consequently, current does not flow in the relay coil of the relay 40, and thus the relay switch connected with the a-c terminal is switched over to the a-b terminal for thereby disconnecting power provided to the defrost heater 50.

Hence, the defrost heater 50 is turned off to finish the defrosting.

As illustrated in FIG. 2, with respect to the above-described operation, the microcomputer 10 checks if seven hours elapse or not by counting the run time of the compressor of the refrigerator and accumulating the same in S101.

As the result of the checking, the defrost heater 50 is turned on to be operated in order to remove the frost adhered to the cooler when seven hours elapse in S102.

A defrost operation is performed for a predetermined time by turning on the defrost heater and melting the frost on the cooler, and thereafter it is checked if the temperature of the cooler has reached the defrost off temperature by sensing the temperature of the cooler in S103.

Herein, if the defrost-off temperature is reached, the defrost heater is turned off in S104 to stop the defrost operation for thus performing a freezing operation, or if the defrost-off temperature is not reached, the defrost heater remains to be on to perform the defrosting operation.

The above-described operation is repeated in such a manner that the defrost heater 50 is turned on every seven hours for thus performing the defrost operation.

However, in the above-described conventional art, since the sheathed heater and the glass tube heater for use in the refrigerator have very high heating temperature where the heater is continuously driven during defrosting, there is a disadvantage that the increased in power consumption, rising in temperature in the freezing chamber, and the occurrence of ice formation in the freezing chamber, but shortage of the defrosting time.

SUMMARY OF THE INVENTION

Accordingly, it is an object of the present invention to provide a method for controlling a defrost heater of a refrigerator which makes it possible to prevent the increase in power consumption, increase in temperature in a freezing chamber, and ice formation in the freezing chamber occurred due to the defrosting temperature rapidly increased by continuously driving the heater.

It is another object of the present invention to provide a method for controlling a defrost heater of a refrigerator which makes it possible to remove frost on a cooler using the quantity of heat during heater-on time and the latent heat during heater-off time under the on-off control of the defrost heater.

To achieve the above objects, there is provided a method for controlling a defrost heater of a refrigerator according to the present invention which includes the steps of:

accumulating the run time of a compressor and checking whether accumulated time has reached a predetermined time for defrosting;

performing a defrost operation, if the predetermined time for defrosting is a first defrosting point of time;

checking the current state of the defrost heater if the predetermined time for defrosting is not a first defrosting point of time;

turning on the defrost heater to perform the on/off control of the defrost heater, if the defrost heater is turned on/off and thereafter the on/off time reaches a predetermined time;

and turning off the defrost heater to finish the defrost operation, if the temperature of cooler has reached a defrost-off temperature during the on/off control of the defrost heater.

Additional advantage, objects and feature of the invention will become more apparent from the description which follows.

BRIEF DESCRIPTION OF THE DRAWINGS

The present invention will become better understood with reference to the accompanying drawings which are given only by way of illustration and thus are not limited to the present invention, wherein.

DETAILED DESCRIPTION OF THE PREFERRED EMBODIMENTS

Hereinafter, the preferred embodiment of the present invention will now be described with reference to the accompanying drawings.

Figure 1:
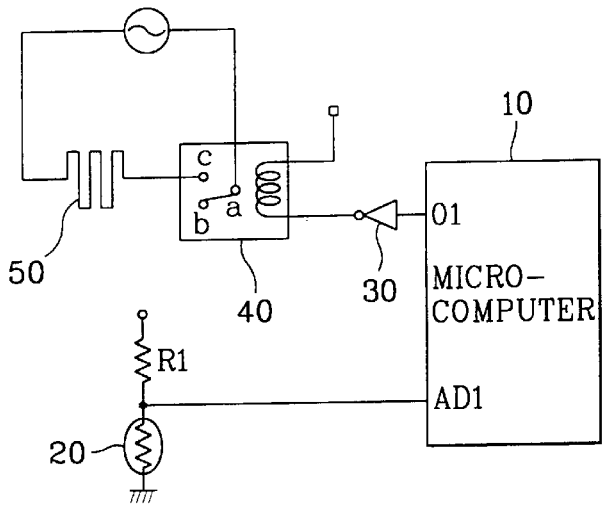
FIG. 1 CONVENTIONAL ART
FIG. 1 is a circuit diagram for driving a defrost heater of a refrigerator according to the conventional art.
Figure 2:
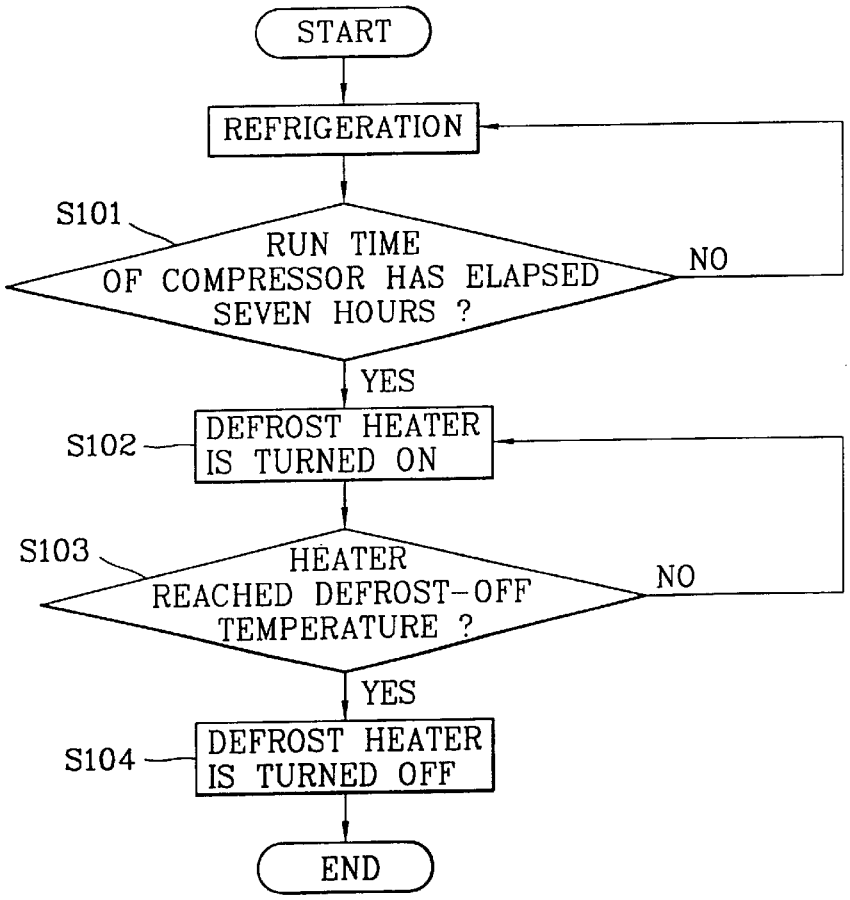
FIG. 2 CONVENTIONAL ART
FIG. 2 is a flow chart of a method for controlling a defrost heater of a refrigerator according to the conventional art.
Figure 3:
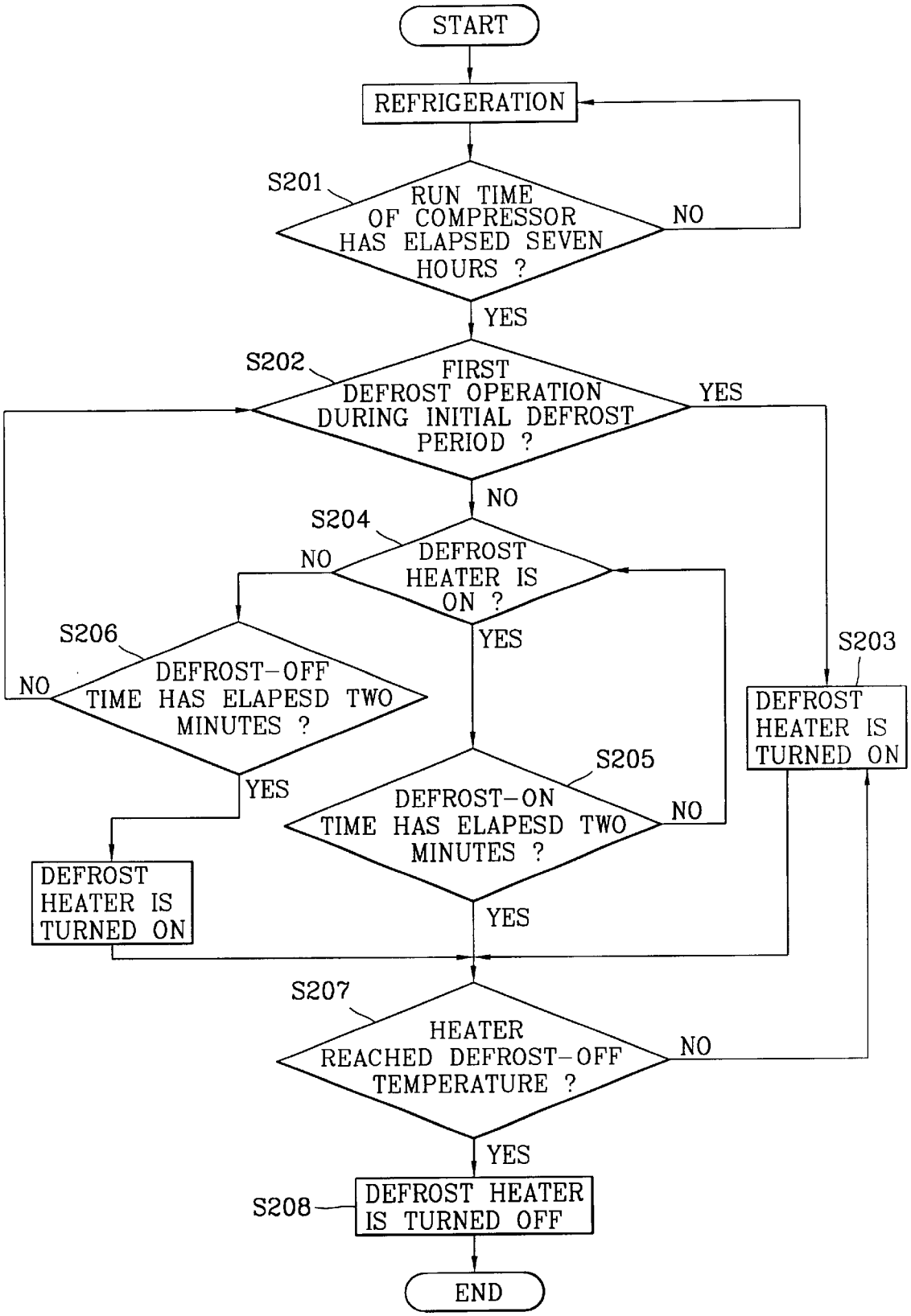
FIG. 3 is a flow chart of a method for controlling a defrost heater of a refrigerator according to the present invention.

FIG. 3 is a flow chart of a method for controlling a defrost heater of a refrigerator according to the present invention. As illustrated therein, the above method includes: a first step of accumulating the run time of a compressor and checking if seven hours has elapsed for defrosting; a second step of turning on the defrost heater to perform defrosting if seven hours elapse and it is a first defrost operation during an initial defrost period; a third step of checking the current state of the defrost heater if seven hours elapse in the first step and it is not an initial defrost period; a fourth step of checking if two minutes elapse after the defrost heater is turned on, if the defrost heater is on at present, or checking if two minute elapse after defrost heater is turned off, if the defrost heater is on at present; and a fifth step of turning on the turned-off defrost heater if two minutes elapse, and thereafter turning off the defrost heater to finish the defrost operation.

The operation and effects of the present invention including the above-specified steps will now be described in detail.

FIG. 3 is a flow chart of a method for controlling a defrost heater of a refrigerator according to the present invention. At first, the refrigerator starts freezing normally as a compressor. Afterwards, in the step S201 of accumulating the run time of the compressor and checking if seven hours elapse for defrosting, the defrost heater is turned on to perform defrost operation if seven hours elapse and it is a first time during an initial defrost period, or the freezing is continued if seven hours does not elapse.

Specifically, when the refrigerator is driven by applying power, the microcomputer 10 counts the run time of the compressor of the refrigerator using an internal timer, and accumulates the counted time.

If the thusly accumulated run time of the compressor of the refrigerator reaches seven hours, the microcomputer 10 recognizes that it must remove the frost adhered on a cooler and checks if the number of times of defrost operations to be performed at present is one or more than one in S202.

In here, the setting of the number of defrost operations means that the defrost heater can be turned on/off as much as setting number of times, although it can be also turned on/off only once.

As the result of the checking, if it is a first defrost operation, the microcomputer 10 outputs a high signal to its output port 01 in order to turn on the defrost heater 50.

The high signal becomes a low state by the inverter 30. Accordingly, current flows in a relay coil of a relay 40, and thus a relay switch connected with an a-b terminal is switched to an a-c terminal to provide power to the defrost heater 50.

Hence, the defrost heater 50 is turned on to start heat generation to remove the frost attached on the cooler. Namely, a defrost operation is performed.

In addition, it is checked whether the defrost heater 50 is on or off, if it is not a first defrost operation during the initial defrost period in S204.

As a result of the checking, the defrost heater 50 is turned on to remove the frost attached on the cooler, whereupon it is confirmed whether two minutes elapsed by checking the time for removal, that is, the defrost-on time in S205. As a result of the confirmation, if the defrost-on time does not reach two minutes, the routine returns to the previous step, or if two minutes elapse, the temperature around the cooler is sensed by the defrosting sensor 20 attached to the cooler.

In the next step, it is checked whether the sensed temperature reaches a defrost-off temperature in S207. If the sensed temperature reaches the defrost-off temperature, the microcomputer 10 outputs a low signal to its output port 01.

The low signal is inverted to a high signal by the inverter 30 to be provided to the relay 40. Then, current does not flow in a relay coil of the relay 40, and thus the relay switch connected with the a-c terminal is switched to the a-b terminal to disconnect the power provided to the defrost heater 50. In this way, the defrost heater is turned off in S208 to finish the defrosting of the refrigerator.

In addition, if the defrost heater 50 is off in a state where it is not a first defrost operation during the initial defrost period, the defrost-off time is checked in S206.

If the defrost-off time reaches two minutes, the defrost heater 50 is turned on to remove the frost attached to the cooler.

When the temperature of the cooler is increased to reach the defrost-off temperature while removing the frost, the defrost heater is turned off to finish the defrost operation.

As described above, the defrost heater such as a sheathed heater or glass tube heater is turned on for two minutes and turned off for two minutes, for thereby removing the defrost on the cooler.

That is, it is possible to prevent from continuous temperature increasing in a freezing chamber, reducing power consumption, and ice formation in the freezing chamber by removing frost on a cooler using the quantity of heat on heater-on time and the latent heat on heater-off time.

As described above, in the present invention, there is effects of preventing the increase in power consumption, increase in temperature of a freezing chamber, and ice formation in the freezing chamber occurred due to the heater temperature rapidly increased by continuously driving the heater, under the periodical on/off control of the defrost heater.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the meets and bounds of the claims, or equivalence of such meets and bounds are therefore intended to be embraced by the appended claims.

What is claimed is:

1. A method for controlling a defrost heater of a refrigerator, comprising the steps of:

accumulating a run time of a compressor and checking whether the accumulated run time has reached a predetermined time for defrosting;

checking if the number of times of defrost operation to be performed at present is one or more than one, and performing a defrost operation if the predetermined time for defrosting is a first defrosting point of time;

checking an on/off state of a defrost heater if the predetermined time for defrosting is not a first defrosting point of time;

turning on the defrost heater during the predetermined time for defrosting if the defrost heater is turned off;

turning off the defrost heater during the predetermined off time if the defrost heater is turned on;

and turning off the defrost heater to finish the defrost operation, if the temperature of cooler has reached a defrost-off temperature during the defrost operation.

2. The method of claim 1, wherein the defrost heater is turned on for a predetermined time and is turned off for a predetermined time.

3. The method of claim 2, wherein the predetermined on time is two minutes and the predetermined off time is two minutes.

4. The method of claim 1, wherein the predetermined accumulated run time of the compressor is set at seven hours.

5. The method of claim 1, wherein the defrosting operation is performed by using heat generated by the defrost heater during heater-on time and latent heat during heater-off time.

* * * * *